US009546537B2

(12) United States Patent
Greci et al.

(10) Patent No.: US 9,546,537 B2
(45) Date of Patent: Jan. 17, 2017

(54) MULTI-POSITIONING FLOW CONTROL APPARATUS USING SELECTIVE SLEEVES

(71) Applicant: HALLIBURTON ENERGY SERVICES, INC., Houston, TX (US)

(72) Inventors: Stephen Michael Greci, Little Elm, TX (US); Luke William Holderman, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 302 days.

(21) Appl. No.: 14/126,417

(22) PCT Filed: Jan. 25, 2013

(86) PCT No.: PCT/US2013/023263
§ 371 (c)(1),
(2) Date: Dec. 14, 2013

(87) PCT Pub. No.: WO2014/116237
PCT Pub. Date: Jul. 31, 2014

(65) Prior Publication Data

US 2014/0262324 A1 Sep. 18, 2014

(51) Int. Cl.

| | |
|---|---|
| ***E21B 34/10*** | (2006.01) |
| ***E21B 43/08*** | (2006.01) |
| ***E21B 43/12*** | (2006.01) |
| ***E21B 33/12*** | (2006.01) |
| ***E21B 34/06*** | (2006.01) |
| *E21B 34/00* | (2006.01) |

(52) U.S. Cl.
CPC ..... *E21B 34/10* (2013.01); *E21B 33/12* (2013.01); *E21B 34/063* (2013.01); *E21B 43/08* (2013.01); *E21B 43/12* (2013.01); *E21B 2034/007* (2013.01)

(58) Field of Classification Search
CPC ..... E21B 43/08; E21B 43/12; E21B 34/063; E21B 34/10; E21B 34/14; E21B 2034/007
See application file for complete search history.

(56) References Cited

U.S. PATENT DOCUMENTS 4,893,678 A 1/1990 Stokley et al.
5,375,662 A * 12/1994 Echols, III ..... E21B 23/04 166/187

(Continued)

OTHER PUBLICATIONS

Foreign Communication from a Related Counterpart Application, International Search Report and Written Opinion dated Oct. 4, 2013, International Application No. PCT/US13/23263 filed on Jan. 25, 2013.

(Continued)

*Primary Examiner* — Jennifer H Gay
(74) *Attorney, Agent, or Firm* — Scott Richardson; Baker Botts L.L.P.

(57) ABSTRACT

An actuating apparatus comprises a sleeve disposed within a wellbore tubular, at least one actuable member, and a deformable seat engaged to the sleeve. The sleeve is configured to longitudinally translate along the wellbore tubular interior, and at least one actuable member engages the sleeve and the wellbore tubular. The deformable seat is configured to form a sealing engagement with a driving member, and the deformable seat is configured to deform in response to the driving member passing through the deformable seat.

20 Claims, 8 Drawing Sheets

(56) References Cited

U.S. PATENT DOCUMENTS 6,253,861 B1 * 7/2001 Carmichael ..... E21B 21/103 175/237
6,622,794 B2 9/2003 Zisk, Jr.
7,021,389 B2 4/2006 Bishop et al.
7,500,526 B2 * 3/2009 Telfer ..... E21B 34/14 166/150
7,503,392 B2 3/2009 King et al.
7,802,621 B2 * 9/2010 Richards ..... E21B 43/08 166/205
8,245,788 B2 8/2012 Garcia et al.
2004/0163820 A1 * 8/2004 Bishop ..... E21B 34/14 166/373
2006/0243455 A1 * 11/2006 Telfer ..... E21B 21/103 166/386
2008/0093080 A1 * 4/2008 Palmer ..... E21B 21/103 166/318
2009/0308588 A1 * 12/2009 Howell ..... E21B 21/103 166/66.4
2010/0000727 A1 * 1/2010 Webb ..... E21B 34/14 166/135
2010/0314133 A1 * 12/2010 O'Brien ..... E21B 34/14 166/386
2011/0030975 A1 * 2/2011 Duphorne ..... E21B 23/006 166/386
2011/0036590 A1 * 2/2011 Williamson ..... E21B 21/103 166/373
2011/0073320 A1 * 3/2011 Fay ..... E21B 23/00 166/373
2011/0192607 A1 * 8/2011 Hofman ..... E21B 34/14 166/317
2011/0198100 A1 * 8/2011 Braekke ..... E21B 34/14 166/386
2011/0232915 A1 * 9/2011 Kellner ..... E21B 21/103 166/373
2011/0240301 A1 * 10/2011 Robison ..... E21B 23/006 166/334.1
2011/0278017 A1 * 11/2011 Themig ..... E21B 34/14 166/373
2011/0315389 A1 * 12/2011 Crider ..... E21B 34/14 166/329
2011/0315390 A1 * 12/2011 Guillory ..... E21B 21/103 166/329
2012/0227973 A1 * 9/2012 Hart ..... E21B 21/103 166/329
2012/0234545 A1 * 9/2012 Xu ..... E21B 43/26 166/308.1
2013/0043041 A1 * 2/2013 McCoy ..... E21B 34/063 166/373
2013/0068474 A1 * 3/2013 Hofman ..... E21B 34/08 166/373
2013/0161017 A1 * 6/2013 King ..... E21B 34/103 166/318
2014/0014340 A1 * 1/2014 King ..... E21B 34/06 166/285
2014/0014360 A1 * 1/2014 Wilson ..... E21B 21/103 166/373
2014/0131109 A1 * 5/2014 Mahajan ..... E21B 23/006 175/57
2014/0166912 A1 * 6/2014 Larisey ..... E21B 43/26 251/61
2014/0262324 A1 * 9/2014 Greci ..... E21B 43/08 166/374
2014/0352970 A1 * 12/2014 Kristoffer ..... E21B 43/12 166/318
2015/0000920 A1 * 1/2015 Harris ..... E21B 34/14 166/308.1
2015/0167428 A1 * 6/2015 Hofman ..... E21B 34/16 166/373

OTHER PUBLICATIONS

International Preliminary Report on Patentability issued in related PCT Application No. PCT/US2013/023263, mailed Aug. 6, 2015 (11 pages).

* cited by examiner

MULTI-POSITIONING FLOW CONTROL APPARATUS USING SELECTIVE SLEEVES

CROSS-REFERENCE TO RELATED APPLICATIONS

This application is a filing under 35 U.S.C. 371 as the National Stage of International Application No. PCT/US2013/023263, filed Jan. 25, 2013, entitled "MULTI-POSITION FLOW CONTROL APPARATUS USING SELECTIVE SLEEVES," both of which are incorporated herein by reference in their entirety for all purposes.

BACKGROUND

Wellbores are sometimes drilled into subterranean formations to produce one or more fluids from the subterranean formation. For example, a wellbore may be used to produce one or more hydrocarbons. Additional components such as water may also be produced with the hydrocarbons, though attempts are usually made to limit water production from a wellbore or a specific interval within the wellbore. Other components such as hydrocarbon gases may also be limited for various reasons over the life of a wellbore.

Where fluids are produced from a long interval of a formation penetrated by a wellbore, balancing the production of fluid along the interval can lead to reduced water and gas coning, and more controlled conformance, thereby increasing the proportion and overall quantity of oil or other desired fluid produced from the interval. Various devices and completion assemblies have been used to help balance the production of fluid from an interval in the wellbore. For example, in a long horizontal wellbore, fluid flow near a heel of the wellbore may be more restricted as compared to fluid flow near a toe of the wellbore, to thereby balance production along the wellbore.

SUMMARY

In an embodiment, an actuating apparatus comprises a sleeve disposed within a wellbore tubular, at least one actuable member, and a deformable seat engaged to the sleeve. The sleeve is configured to longitudinally translate along the wellbore tubular interior, and at least one actuable member engages the sleeve and the wellbore tubular. The deformable seat is configured to form a sealing engagement with a driving member, and the deformable seat is configured to deform in response to the driving member passing through the deformable seat.

In an embodiment, a method of reconfiguring a flow control apparatus comprises blocking, by a sleeve, a flow path between an exterior of a wellbore tubular and an interior of the wellbore tubular, engaging a driving member with a seat disposed on the sleeve, increasing the pressure differential across the driving member when the driving member is engaged with the seat, axially translating the sleeve in response to increasing the pressure differential across the driving member, passing the driving member through the seat, deforming the seat in response to passing the driving member through the seat, and providing a flow path between the exterior of a wellbore tubular and the interior of the wellbore tubular. The sleeve is disposed within the wellbore tubular, and the sleeve is configured to axially translate along the interior of the wellbore tubular In an embodiment, a method of reconfiguring a flow control apparatus comprises disposing a first driving member within a flow control apparatus in a first configuration.

The flow control apparatus comprises: a sleeve disposed within a wellbore tubular; a seat disposed on the sleeve; and a first flow path between an exterior of the wellbore tubular and an interior of the wellbore tubular. The method also comprises engaging the first driving member with the seat, translating the sleeve along an interior surface of the wellbore tubular from a first position to a second position in response to engaging the first driving member with the seat, reconfiguring the flow control apparatus to a second configuration in response to translating the sleeve from the first position to the second position, engaging a second driving member with the seat, translating the sleeve along an interior surface of the wellbore tubular from the second position to a third position in response to engaging the second driving member with the seat, and reconfiguring the flow control apparatus to a third configuration in response to translating the sleeve from the second position to the third position. The second configuration comprises at least one of a closed configuration, a restricted configuration, or an open configuration, and the third configuration comprises at least one of a closed configuration, a restricted configuration, or an open configuration.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
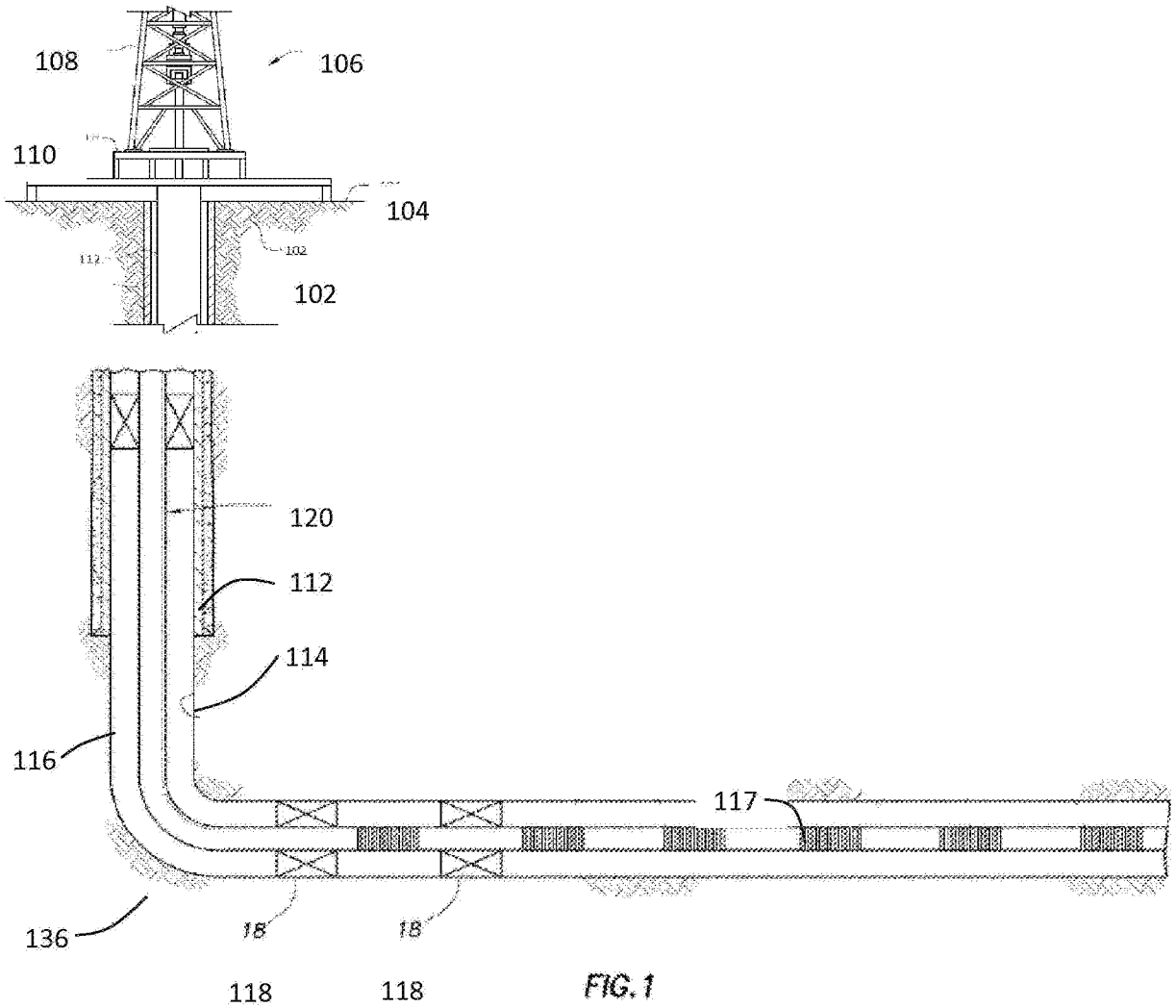
FIG. 1 is a schematic illustration of an embodiment of a wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Various devices and completion assemblies have been used to help balance the production of fluid from an interval in the wellbore. For example, various flow control devices can be used to balance the production along one or more intervals by adjusting the resistance to flow at various points along the wellbore. The resistance to flow can be adjusted at various points of the life of the wellbore to allow one or more additional procedures to be performed and/or to adjust for changes in the reservoir properties. For example, the production or completion assemblies may be disposed in a wellbore in a closed configuration to allow for pressure testing and/or the development of pressure within the completion assembly to operate various tools. Once the desired operations are complete, the completion or production assemblies may be selectively actuated to the desired production positions. At various subsequent times, the assemblies may be selectively closed, opened, and/or shifted to new positions as desired.

In general, completion assemblies can be actuated using physical interventions in the wellbore, such as tools coupled to a wireline or a slickline. Such operations require time to transition the tools within the wellbore and remove the tool after actuating one or more of the assemblies. Rather than relying on physical interventions, the system disclosed herein may generally rely on a driving member such as a dart or ball to selectively actuate one or more assemblies from a first position to a second position. In general, the completions disclosed herein comprise a shifting sleeve having a deformable seat disposed within the wellbore tubular. A driving member may engage the seat and shift the sleeve from a first position to a second position using a pressure differential across the driving member. Once the sleeve is shifted, the seat may be configured to deform and release the driving member. The driving member may then pass through the wellbore to optionally shift one or more additional sleeves along the wellbore tubular string. Such an embodiment may allow one or more assemblies along a completion or production string to be reconfigured without the need to use a tool coupled to the surface of the wellbore.

The system disclosed herein may also allow for multiple actuations between a plurality of positions. For example, the assemblies may be further shifted to a third or subsequent position using additional driving members. The additional driving members may be progressively larger in diameter to develop larger shifting forces. The sleeve may then transition or shift from the second position to a third position. The seat may then further deform to release the driving member. The driving member may then transition along the wellbore tubular string to shift one or more additional sleeves. In this manner, the driving members may be used to reconfigure a wellbore tubular string a number of times in a simple and efficient manner.

Referring to FIG. 1, an example of a wellbore operating environment in which a flow control device may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 117. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in the wellbore 114.

In an embodiment, the wellbore tubular string 120 may comprise a completion assembly string comprising one or more wellbore tubular types and one or more downhole tools (e.g., zonal isolation devices 118, screens, valves, etc.). The one or more downhole tools may take various forms. For example, a zonal isolation device 118 may be used to isolate the various zones within a wellbore 114 and may include, but is not limited to, a packer (e.g., production packer, gravel pack packer, frac-pac packer, etc.). In an embodiment, the wellbore tubular string 120 may comprise a plurality of well screen assemblies, which may be disposed within the horizontal wellbore portion 117. The zonal isolation devices 118 may be used between various ones of the well screen assemblies, for example, to isolate different zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

The flow control apparatus described herein allows for fluid flow, the resistance to fluid flow, and/or the flow rate through the flow control apparatus to be selectively adjusted. The flow control apparatus described herein may generally comprise a sleeve disposed within a wellbore tubular, where the sleeve is configured to longitudinally displace along the wellbore tubular to predetermined locations. The flow control apparatus described herein may also generally comprise a plurality of actuable members configured to retain the sleeve at the predetermined locations. Additionally, the flow control apparatus describe herein may comprise a deformable seat coupled to the sleeve. The ability to shift the sleeve may allow the flow control apparatus to be adjusted with a minimal amount of intervention within the wellbore. For example, the flow control apparatus may be adjusted by disposing a shifting device such as a ball or dart within the wellbore tubular and applying pressure to shift the sleeve.

Figure 2:
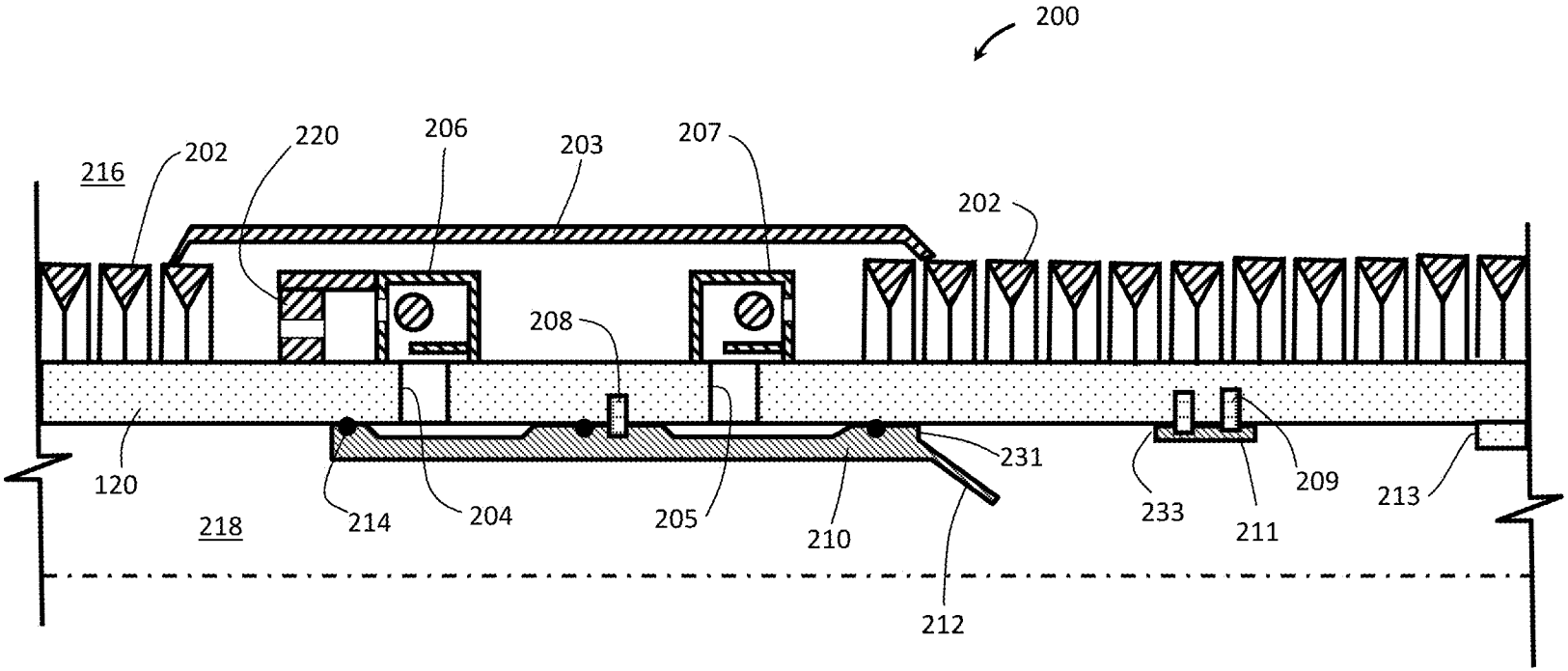
FIG. 2 is a partial cross-sectional view of an embodiment of a flow control apparatus.

Referring now to FIG. 2, a schematic partially cross-sectional view of one of the well screen assemblies is representatively illustrated. The well screen assembly may generally comprise a flow control device 200 configured to provide a flow path between a filter element 202 and a wellbore tubular throughbore 218, which may also be referred to as the wellbore tubular interior 218. The flow control apparatus 200 is one of several different examples of flow control apparatuses described below in alternate configurations. The flow control apparatus 200 may perform several functions and be configured in several different states. In an embodiment, the flow control apparatus 200 may be configured in a closed position. In the closed position, the flow control apparatus 200 may substantially prevent flow between the wellbore tubular exterior 216 and the wellbore tubular interior 218, for example, to pressure test and/or set a packer. In an embodiment, the flow control apparatus 200 may be configured in a choked or restricted configuration. In the restricted configuration, the flow control apparatus 200 may comprise a flow restriction such as an inflow control device (ICD) and/or an autonomous inflow control device (AICD), and the flow control apparatus 200 may provide a flow path between the wellbore tubular exterior 216 and the wellbore tubular interior 218 that restricts flow therethrough, for example, to balance production of fluid along an interval. In an embodiment, the flow control apparatus 200 may be configured in an open and/or bypassed configuration. In the open configuration, the flow control device 200 may provide a relatively unrestricted flow path between the wellbore tubular exterior 216 and the wellbore tubular interior 218. Each of these configurations is described in more detail herein.

The flow control device may comprise a housing 203 disposed about the wellbore tubular 120, at least one port 204 disposed in the wellbore tubular 120, and at least one valve 206, 207 configured to control flow between the wellbore tubular interior 218 and an exterior 216 of the flow control device 200 and/or the filter element 202 in at least one direction. A flow path between the wellbore tubular exterior 216 and the wellbore tubular interior 218 may pass through the filter element 202, through one or more of the valves 206, 207, through one or more ports 204, 205, and into the wellbore tubular interior 218. In some embodiments a flow restriction 220 such as an ICD and/or an AICD may be disposed in the flow path. For example, an ICD and/or AICD may be disposed between the valve 206 and the filter element 202 and/or adjacent to or within the port 204. While illustrated as having a filter element on either end of the housing, it will be appreciated that the housing 203 may engage the wellbore tubular 120 on at least one end, and the flowpath may enter the housing from the end engaging the filter element.

The housing 203 can comprise a generally cylindrical member disposed about the wellbore tubular 120. The housing 203 may be fixedly engaged with the wellbore tubular 120 and one or more seals may be disposed between the housing 203 and the exterior surface of the wellbore tubular 120 to provide a substantially fluid tight engagement between the housing 203 and the wellbore tubular 120. In some embodiments, the housing 203 may be coupled to the wellbore tubular 120 via a threaded connection, though various suitable retaining members including clips, screws, welds, and the like may be used to couple and retain the housing 203 to the wellbore tubular 120. In some embodiments, the housing 203 may be coupled to the filter element 202, which may in turn be coupled to the wellbore tubular 120.

The filter element 202 is used to separate at least a portion of any sand and/or other debris from a fluid that generally flows from an exterior 216 to an interior 218 of the screen assembly. The filter element 202 is depicted in FIG. 2 as being of the type known as "wire-wrapped," since it is made up of a wire closely wrapped helically about a wellbore tubular 120, with a spacing between the wire wraps being chosen to keep sand and the like that is greater than a selected size from passing between the wire wraps. Other types of filters (such as sintered, mesh, pre-packed, expandable, slotted, perforated, etc.) may also be used. The filter element 202 may also comprise one or more layers of the filter material. The flow path can be disposed between the filter portion 202 and the wellbore tubular 120 to allow a fluid passing through the filter portion 202 to flow along the outer surface of the wellbore tubular 120 and into the flow control device 200.

The valve 206, 207 may be used to regulate fluid communication along the flow path between the wellbore tubular interior 218 and the wellbore tubular exterior 216. The valve may allow a pressure differential to be established between the wellbore tubular interior 218 and the wellbore tubular exterior 216, which may allow for actuation of the sleeve 210 from one position to the next. In an embodiment, the valve 206, 207 may be used to prevent and/or restrict fluid communication in one direction such as along a flow path from the wellbore tubular interior 218 to the wellbore tubular exterior 216. In an embodiment, the valve 206, 207 may comprise a one-way valve (e.g., a check valve, a velocity valve, etc.), a two-way valve, and/or any other type of valve known by those of ordinary skill in the art. The valve 206, 207 may be actuated manually and/or by an automated command, in response to a sensed parameter, and/or in direct response to a change in a parameter. In an embodiment, the parameter may comprise pressure, fluid density, and/or flow rate, for example. For example, the valve 206, 207 may close when a pressure differential between the wellbore tubular interior 218 and the wellbore tubular exterior 216 exceeds a threshold, and/or when a flow rate from the wellbore tubular interior 218 to the wellbore tubular exterior 216 exceeds a threshold flow rate. The valve 206, 207 may open when a pressure differential and/or a fluid flow rate between the wellbore tubular interior 218 and wellbore tubular exterior 216 is below a threshold and/or when a the pressure on the wellbore tubular exterior 216 is greater than the pressure in the wellbore tubular interior 218.

The flow restriction 220 may generally be disposed within the fluid pathway between the filter element 202 and the port 204. For example, the flow restriction 220 may be disposed between the filter element 202 and the valve 206, between the valve 206 and the port 204, and/or within the port 204 (e.g., using a nozzle type restriction). The flow restriction 220 is configured to provide a desired resistance to fluid flow through the flow restriction 220, and may be selected to provide a resistance for balancing the production along an interval. Various types of flow restrictions 220 can be used with the flow control device 200 described herein. In the embodiment shown in FIG. 2, the flow restriction 220 comprises a nozzle that comprises a central opening (e.g., an orifice) configured to cause a specified resistance and pressure drop in a fluid flowing through the flow restriction 220. The central opening may have a variety of configurations from a rounded cross-section, to cross section in which one or more of the edges comprises a sharp-squared edge. In general, the use of a squared edge at either the edge of the nozzle may result in a greater pressure drop through the orifice than other shapes. Further, the use of a squared edge may result in a pressure drop through the flow restrictor that depends on the viscosity of the fluid passing through the flow restriction. The use of a squared edge may result in a greater pressure drop through the flow restrictor for an aqueous fluid than a hydrocarbon fluid, thereby presenting a greater resistance to flow for any water being produced relative to any hydrocarbons (e.g., oil, gas, etc.) being produced. Thus, the use of a central opening comprising a squared edge may advantageously resist the flow of water as compared to the flow of hydrocarbons. In some embodiments described herein, a plurality of nozzle type flow restrictions may be used in series.

The flow restrictions 220 may also comprise one or more restrictor tubes. The restrictor tubes generally comprise tubular sections with a plurality of internal restrictions (e.g., orifices). The internal restrictions are configured to present the greatest resistance to flow through the restrictor tube. The restrictor tubes may generally have cylindrical cross-sections, though other cross-sectional shapes are possible. The restrictor tubes may be disposed within the fluid pathway with the fluid passing through the interior of the restrictor tubes, and the restrictor tubes may generally be aligned with the longitudinal axis of the wellbore tubular 120 within the fluid pathway. The plurality of internal restrictions may then provide the specified resistance to flow.

The internal restrictions may be the same or similar to the central openings described with respect to the nozzle type flow restrictions above. In an embodiment, one or more of the internal restrictions may comprise a square edged. In some embodiments, one or both of the edges can be provided without a fillet or chamfer added to the edge and can even be manufactured to be sharp. The internal restrictions may have squared shoulders at the interior edges between the internal restrictions and the inner surface of the restrictor tube. In an embodiment, the longitudinal length of the restrictor tube may be at least two times greater than the longitudinal length of any of the one or more internal restrictions. The configuration of the internal restrictions (e.g., cross-sectional shape, internal diameter, longitudinal length, etc.) can be the same or different for each of the internal restrictions of the plurality of internal restrictions. As with the use of one or more nozzle type flow restrictions, the use of a restrictor tube comprising a plurality of internal restrictions that comprise one or more squared edges may advantageously resist the flow of water as compared to the flow of hydrocarbons.

Other suitable flow restrictions may also be used including, but not limited to, narrow flow tubes, annular passages, bent tube flow restrictors, helical tubes, and the like. Narrow flow tubes may comprise any tube having a ratio of length to diameter of greater than about 2.5 and providing for the desired resistance to flow. Similarly, annular passages comprise narrow flow passages that provide a resistance to flow due to frictional forces imposed by surfaces of the fluid pathway. A bent tube flow restrictor comprises a tubular structure that forces fluid to change direction as it enters and flows through the flow restrictor. Similarly, a helical tube flow restrictor comprises a fluid pathway that forces the fluid to follow a helical flow path as it flows through the flow restrictor. The repeated change of momentum of the fluid through the bent tube and/or helical tube flow restrictors increases the resistance to flow and can allow for the use of a larger flow passage that may not clog as easily as the narrow flow passages of the narrow flow tubes and/or annular passages. Each of these different flow restriction types may be used to provide a desired resistance to flow and/or pressure drop for a fluid flow through the flow restrictor. Since the resistance to flow may change based on the type of fluid, the type of flow restriction may be selected to provide the desired resistance to flow for one or more type of fluid.

Continuing with FIG. 2, the flow control device 200 comprises a sleeve 210 disposed within the wellbore tubular 120. The sleeve 210 may be configured to axially translate along the wellbore tubular 120 interior surface. The sleeve 210 may be configured so that the sleeve 210 may at least partially obstruct one or more ports 204, 205 to thereby selectively allow or prevent fluid communication between the wellbore tubular exterior 216 and the wellbore tubular interior 218. In general, the sleeve 210 may comprise a generally cylindrical member having an outer diameter corresponding to the inner diameter of the wellbore tubular 120. The sleeve 210 may engage the inner surface of the wellbore tubular 120. One or more seals 214 may be disposed between the sleeve 210 and the wellbore tubular 120 to form a sealing engagement between the two components. The seal 214 may be an o-ring, a t-seal, or any other member that could provide a seal between the sleeve 210 and the wellbore tubular 120. While FIG. 2 depicts that the seal 214 is disposed inside the sleeve 210, the seal 214 may be disposed at the end of the sleeve 210, within a housing of the tubular member 120, and/or against the tubular member 120. Additionally, the seal 214 may be disposed at multiple locations between the sleeve 210 and the interior wall of the wellbore tubular 120. To this effect, seals 214 may be disposed longitudinally on either side of an aperture and/or at the ends of the sleeve 210.

As shown in FIG. 2, the flow control apparatus 200 may also comprise at least one deformable seat 212 disposed on the sleeve 210. The seat 212 may be a rubber and/or metal seat configured to receive a driving member, such as a ball and/or dart. In an embodiment, pressure may be applied to the driving member when the driving member engages the seat 212 in order to apply an axial force to the seat 212 and axially displace the sleeve 210 along the wellbore tubular 120. In an embodiment, the seat 212 may be configured to deform (e.g., elastically, plastically, etc.) when a threshold force is applied on it. The threshold force may correlate to a threshold pressure. To this effect, when a driving member is disposed on the seat 212 and pressure on the driving member reaches a threshold, the seat 212 may deform and permit the driving member to pass through the wellbore tubular 120. Once the driving member passes through the wellbore tubular 120, the seat 212 may return substantially to its original form (i.e. before the driving member was disposed on seat 212). In some embodiments, the driving member may permanently deform and/or alter the seat 212. For example, the driving member may increase the cross-sectional area through seat 212.

In an embodiment, seat may comprise a plurality of collet indicators (e.g., spring actuated retractable indicators) radially disposed around the sleeve 210 and extending radially inward from the sleeve 210. The retractable indicators may be biased inwards to engage a driving member, as described in more detail herein. The distance through which the collet indicators are displaced may determine the amount of force that can be applied to translate the sleeve 210. The force applied to translate the sleeve can then be controlled by the diameter of the driving member used to translate the sleeve, where a larger diameter driving member provides a larger translation force than a smaller diameter driving member.

The actuable member 208 may engage the sleeve 210 and may be configured to hold the sleeve 210 at a predetermined longitudinal position along the interior wall of the wellbore tubular 120 in an initial configuration. The actuable members 208, 209 may comprise a device configured to provide a resistance up to a threshold and thereafter allow for movement. Suitable actuable members 208, 209 may include, but are not limited to, shear screws, shear pins, shear rings, and in some embodiments, collet indicators and the like. In an embodiment, the actuable members 208, 209 may pass through and engage both the sleeve 210 and the wellbore tubular 120, thereby coupling the sleeve to the wellbore tubular 120 prior to actuation of the actuable member 208. The actuable members may also comprise one or more threads that are configured to shear or deform when subjected to a sufficient force. In some embodiments, when a longitudinal force applied on the sleeve 210 reaches a threshold, the threads on the sleeve 210 may ratchet over the threads on the wellbore tubular 120, thereby allowing the sleeve 210 to translate longitudinally.

In an embodiment, the actuable members may comprise a plurality of spring actuated retractable indicators (i.e. collet indicators) radially disposed around the sleeve 210. The retractable indicators may be biased outwards to engage a port 204 or other indicator disposed on the inner surface of the wellbore tubular 120. In this embodiment, the actuable members may have an angled side so that when a force is applied on the sleeve 210, the normal force from the port wall, for example, may slide the indicators into a sleeve housing to release the sleeve 210 from its position. The angle of the side of the actuable member and/or the shear strength of the actuable member may determine the amount of force needed to move the sleeve 210. The spring force on the actuable member may determine the amount of force needed to displace the sleeve 210.

As shown in the embodiment of FIG. 2, a first actuable member 208 engages the sleeve 210 and holds the sleeve 210 at a first axial position along the interior wall of the wellbore tubular 120. One or more second actuable members 208, 209 may engage a ring stop 211 and hold the ring stop 211 at a second predetermined longitudinal position along the interior of the wellbore 218. It should be understood that although FIG. 2 depicts one actuable member 208 and two actuable members 208, 209, and any number of actuable members may be used with the sleeve 210 and/or any number of ring stops 211. The number of actuable members may generally depend on the amount of force desired for maintaining the sleeve 210 and/or the ring stop 211 in position. In an embodiment, one, two, or any plurality of actuable members may be used to engage the sleeve 210 and/or the ring stop 211. When a plurality of actuable members engages the sleeve 210 and/or the ring stop 211, the actuable members may be distributed circumferentially about the interior of the wellbore tubular 120.

In an embodiment, the actuable members 208. 209 engaging the ring stop 211 may serve to define a location at which the sleeve 210 may be retained upon actuating the actuable member 208. For example, when one or more of the actuable members hold the sleeve 210 at a first axial position fails, the sleeve may axially translate into engagement with the ring stops 211. The actuable members 208, 209 engaging the ring stop 211 may then provide a resistance to further axial movement and thereby maintain the sleeve 210 in a second position. A no-go shoulder 213 may be disposed on the inner surface of the wellbore tubular 120 to serve as a further stop when the actuable members 208, 209 fail. Any number of ring stops and a no-go shoulders may be used to define the axial positions of the sleeve 210 along the wellbore tubular 120. The aggregate force required to actuate the actuable members 208, 209 may generally increase as the sleeve 210 axially translates along the wellbore tubular 120, so that an increasing force is required for each sequential actuation.

Figure 3:
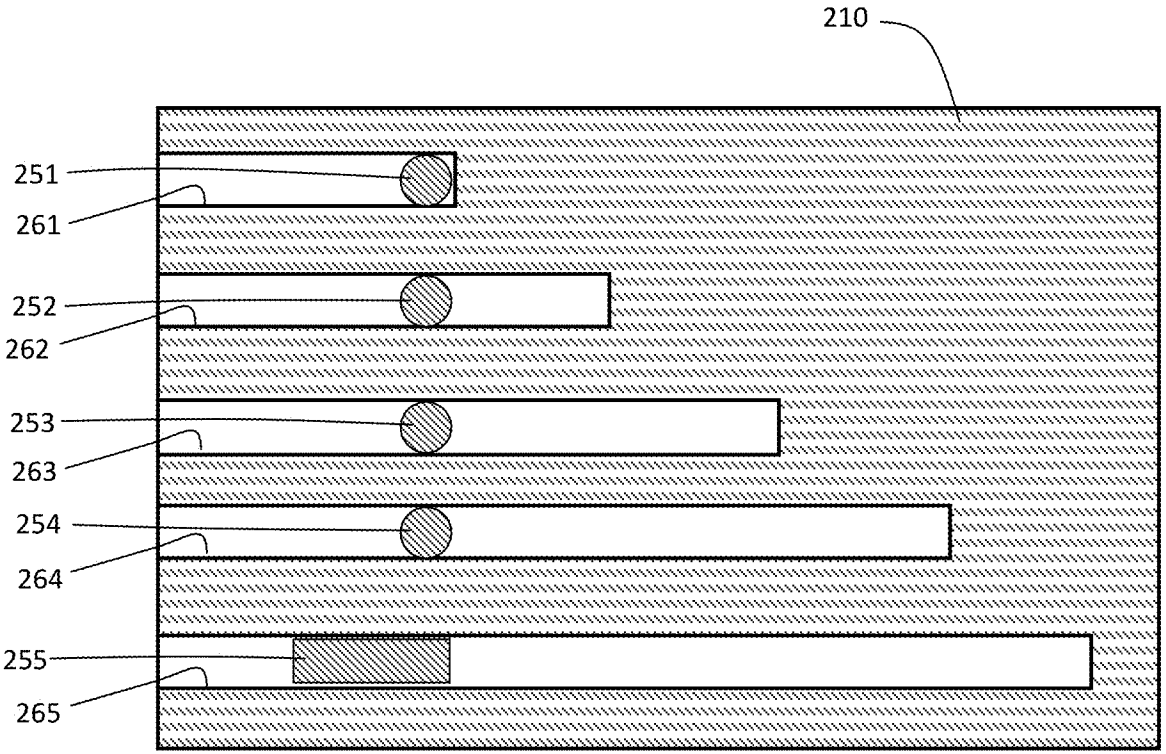
FIG. 3 is a partial circumferential view of an embodiment of a sleeve of a flow control apparatus.

FIG. 3 illustrates a circumferential view (e.g., as if the cylindrical sleeve were laid flat) of an embodiment of the sleeve 210. In this embodiment, a plurality of actuable members 251, 252, 253, 254 may be disposed in the wellbore tubular 120 and extend outward into channels or grooves 261, 262, 263, 264 disposed in the outer surface of the sleeve 210. The first actuable member 251 may engage the end of the first channel 261. Upon the application of a sufficient force as described in more detail herein, the first actuable member 251 may actuate to allow the sleeve 210 to shift in the direction of the force (e.g., to the left in FIG. 3). The second actuable member 252 may then engage the end of the second channel 262 to prevent the further movement of the sleeve 210. This process may be continued upon the actuation of the third actuable member 253 in the third channel 263, and the actuation of the fourth actuable member 254 in the fourth channel 264. The actuable members 251, 252, 253, 254 may have progressively higher thresholds for actuating, thereby providing for the translation of the sleeve 210 in response to an increasing force applied to the seat, for example using progressively larger driving members. Upon actuation of the last actuable member 254, the last channel 265 may translate into engagement with an indicator 255. The indicator may be configured to retain the sleeve 210 in position and prevent further translation of the sleeve 210 within the wellbore tubular. While illustrated as comprising four actuable members with four potential translation positions, it should be understood that more than four positions may be provided or less than four positions may be provided by supplying the appropriate number of channels and actuable members.

In use, the flow control apparatus 200 may be used to transition between various states or configurations of the flow control device 200 including a closed configuration, a restricted configuration, and/or an open configuration. The embodiment illustrated in FIG. 2 shows the flow control device 200 in a closed configuration. In this embodiment, the actuable member 208 is engaged with the sleeve 210, and the sleeve 210 is disposed at a position along the wellbore tubular 120 so that sleeve 210 is disposed over the ports 204, 205 and thereby obstructing any flow paths between the wellbore tubular interior 218 and the wellbore tubular exterior 216. The seals 214 may operate in conjunction with the sleeve 210 to prevent fluid communication between the wellbore tubular exterior 216 and wellbore tubular interior 218 through the ports 204, 205.

Figure 4:
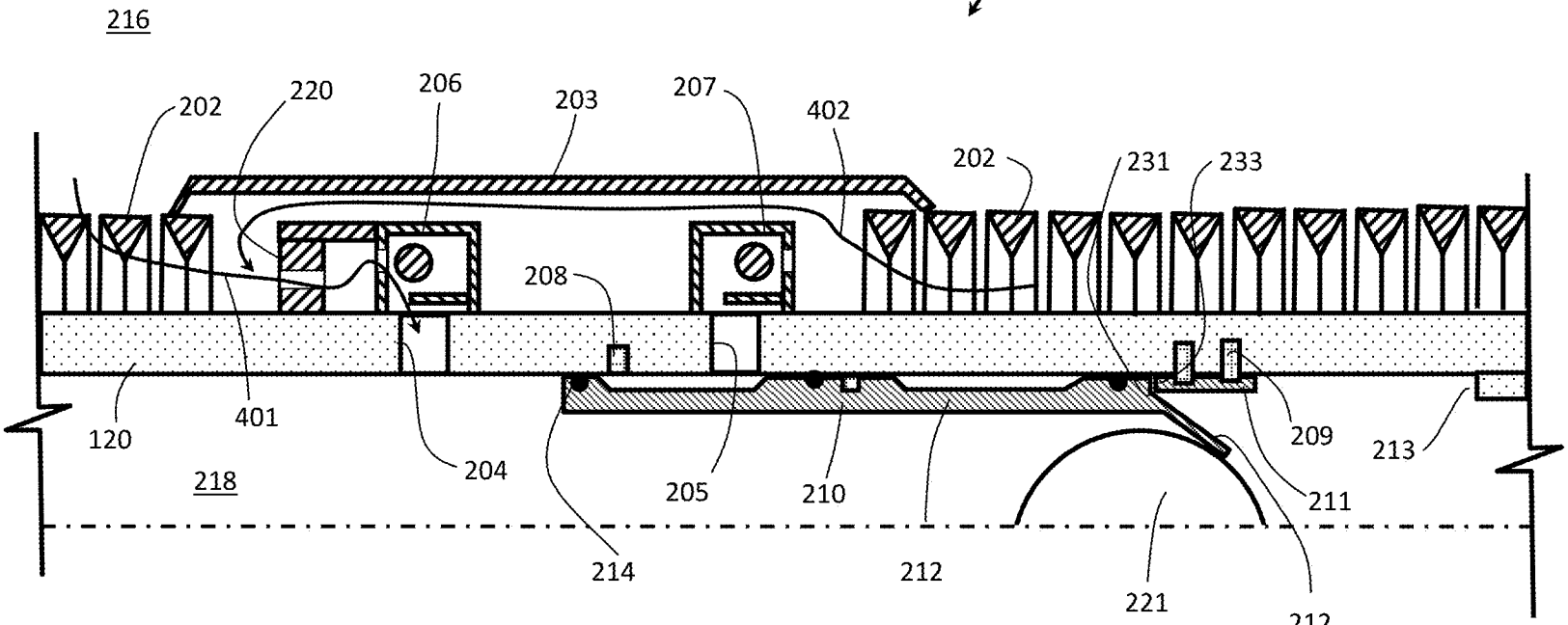
FIG. 4 is another partial cross-sectional view of an embodiment of a flow control apparatus in a second configuration.

As illustrated in FIGS. 2 and 4, the flow control device 200 may be transitioned from the closed configuration to the restricted configuration by engaging a driving member 221 with the seat 212 in the throughbore 218. When the first driving member 221 is engaged with the seat 212, the driving member 221 may sealingly engage the seat 212 and thereby prevent fluid communication through the wellbore tubular interior 218 past the driving member 221. When the driving member 221 is engaged with the seat 212, fluid may be pumped into the wellbore tubular interior 218, which may increase the pressure within the throughbore 218 and/or increase a pressure differential across the driving member 221. The resulting pressure differential may act on the area of the driving member 221 to create an axial force. When the axial force exceeds a threshold, the actuable member 208 engaging the sleeve 210 may actuate or fail to release the sleeve 210. The driving member 221 may remain engaged with the seat 212 as the sleeve 210 axially translates until a lower shoulder 231 on the sleeve 210 engages an upper shoulder 233 on the ring stop 211. The port 204 may be exposed as the end of the sleeve axially translates. The valve 206 may then be actuated to prevent fluid flow from the wellbore interior 218 to the wellbore tubular exterior 216, thereby preventing fluid from flow outward and releasing the pressure buildup behind the driving member 221. With the fluid maintained within the wellbore tubular interior 218, the sleeve 210 may continue to axially translate until engaging the ring stop 211. Upon engaging the ring stop 211, the sleeve 210 may be retained in the position illustrated in FIG. 4. The actuable member 209 may be configured to retain the sleeve to allow the force on the first driving member to be increased so that it may pass through the seat 212 without further axial movement of the sleeve 210. In an embodiment, the actuable members 208, 209 engaging the ring stop 211 may require a higher threshold force to actuate than the actuable member or members 208 engaging the sleeve 210, which may allow the first driving member to actuate the actuable member or members 208 while not actuating the actuable members 208, 209 engaging the ring stop 211.

Upon engaging the ring stop 211, the pressure behind the first driving member 221 may increase until the first driving member 221 deforms and/or alters the seat 212 to allow the first driving member 221 to be released from and pass through the seat 212. The pressure behind the first driving member 221 may be increased above a threshold pressure for deforming and/or altering the seat 212. In an embodiment, the first driving member 221 may elastically and/or inelastically deform the seat 212, permitting the first driving member 221 to pass through the seat 212. In some embodiments, the first driving member may alter the seat 212 to allow the first driving member 221 to pass through the seat 212. For example, the seat 212 may tear, fragment, and/or a portion of the seat may be removed so that the diameter of the seat increases to allow the first driving member to pass through the seat 212. Once the first driving member 221 passes through the seat 212, the first driving member 221 may pass through the wellbore tubular interior 218 to the bottom of the wellbore or to engage another seat on a downstream sleeve, as described in more detail herein.

When the sleeve has shifted to the restricted configuration, a flowpath 301 may be established between the wellbore tubular exterior 216 and the wellbore tubular interior 218. The flowpath 301 may direct any fluid to flow from the exterior of the wellbore tubular 216, through the filter element 202, through the flow restriction 220, into the valve 206, through the port 204, and into the wellbore tubular interior 218. An optional additional flowpath 302 may also be present that allows fluid to flow through a second filter element and into the flow restriction 220. Flow along a reverse pathway may be prevented by the valve 206. In the restricted configuration, the sleeve 210 may be disposed over and/or substantially prevent fluid flow through the second port 205. Thus, any fluid flow is directed through the flow restriction 220. Fluid may then be produced along the flowpath 301, 302 into the interior 218 of the wellbore tubular 120.

Figure 5:
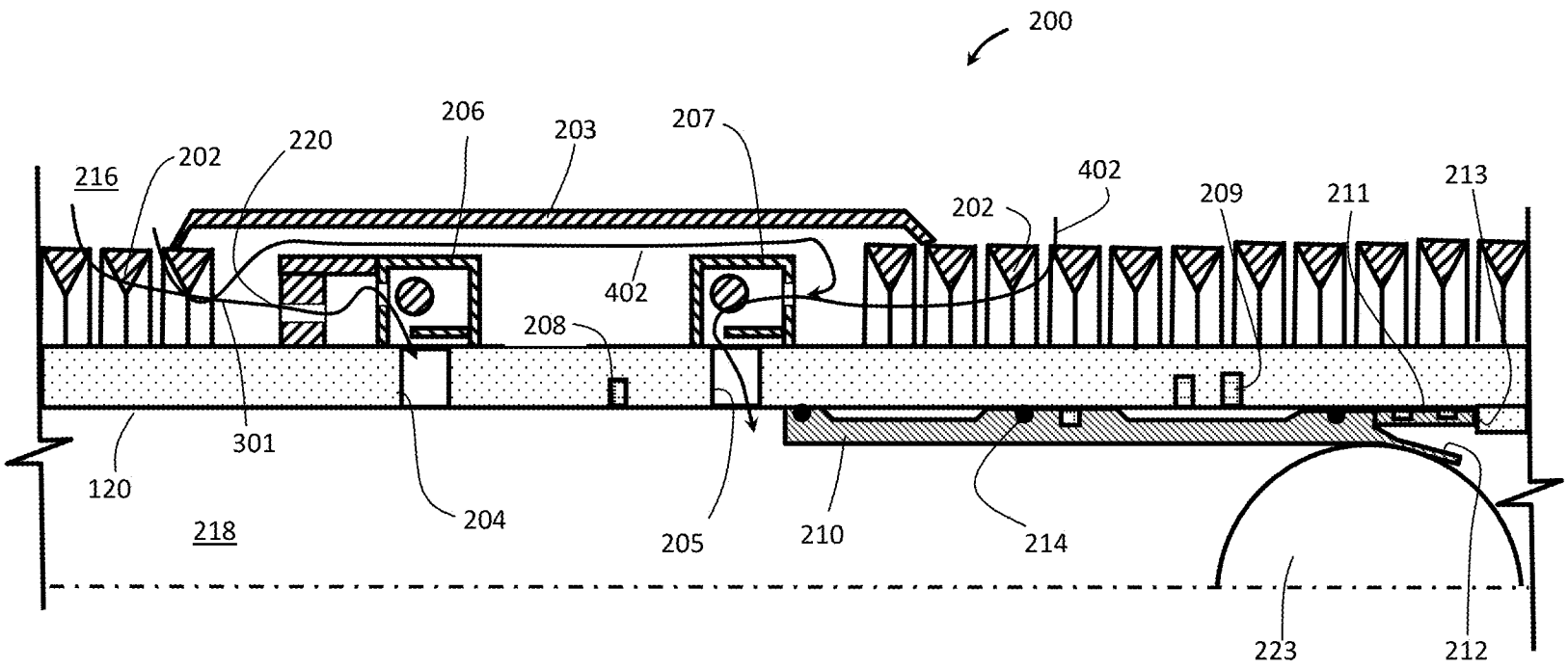
FIG. 5 is still another partial cross-sectional view of an embodiment of a flow control apparatus in a third configuration.

As illustrated in FIGS. 4 and 5, the flow control device 200 may be transitioned from the restricted configuration to the open configuration by engaging a second driving member 223 with the seat 212 in the throughbore 218. When the second driving member 223 is engaged with the seat 212, the driving member 221 may sealingly engage the seat 212 and thereby prevent fluid communication through the wellbore tubular interior 218 past the driving member 221. In order to dispose the second driving member 223 in the wellbore and into engagement with the seat 212, fluid may be pumped into the wellbore tubular interior 218. A pressure may be developed behind the second driving member 223 by actuating the valve 206 to a closed position, which may occur upon increasing the pressure within the wellbore tubular interior 218 above a threshold amount relative to the wellbore tubular exterior 216 and/or establishing a flow rate from the wellbore tubular interior 218 to the wellbore tubular exterior 216 above a threshold.

In an embodiment, the second driving member 223 may have a larger size and/or larger cross-sectional area than the first driving member 221. The larger size may allow the second driving member 223 to engage the seat 212 which may have been inelastically deformed and/or altered by the passage of the first driving member 221. Whether or not the seat 212 was changed by the passage of the first driving member 221, the larger size may also allow for a larger axial force to be developed on the second driving member 223 and the sleeve 210. The force developed by the second driving member 223 may be above the threshold for actuating the actuable members 208, 209 retaining the stop ring 211 in position.

When the valve 206 is closed and the second driving member 223 is engaged with the seat 212, fluid may be pumped into the wellbore tubular interior 218, which may increase the pressure within the throughbore 218 and/or increase a pressure differential across the second driving member 223. The resulting pressure differential may act on the area of the second driving member 223 to create an axial force on the sleeve 210. When the axial force exceeds a threshold, the actuable members 208, 209 engaging the stop ring 211 may actuate or fail to release the stop ring 211. Once the stop ring 211 is released, the stop ring 211 and the sleeve 210 engaging the stop ring may axially translate towards the no-go shoulder 213, and the second driving member 223 may remain engaged with the seat 212 as the stop ring 211 and the sleeve 210 axially translate towards the no-go shoulder 213. The port 205 may be exposed as the end of the sleeve 210 axially translates towards the no-go shoulder 213. The valve 207 may then be actuated to prevent fluid flow from the wellbore interior 218 to the wellbore tubular exterior 216, thereby preventing fluid from flow outward and releasing the pressure buildup behind the second driving member 223. With the fluid maintained within the wellbore tubular interior 218, the stop ring 211 and the sleeve 210 may continue to axially translate until engaging the no-go shoulder 213. Upon engaging the no-go shoulder, the ring stop 211 and the sleeve 210 may be retained in the position illustrated in FIG. 5. The no-go shoulder 213 may be configured to retain the sleeve 210 to allow the force on the second driving member 223 to be increased so that it may pass through the seat 212 without further axial movement of the sleeve 210.

Upon engaging the no-go shoulder 213, the pressure behind the second driving member 223 may increase until the second driving member 223 deforms and/or alters the seat 212 to allow the second driving member 223 to be released from and pass through the seat 212. The pressure behind the second driving member 223 may be increased above a threshold pressure for deforming and/or altering the seat 212. In an embodiment, the second driving member 223 may elastically and/or inelastically deform the seat 212, permitting the second driving member 223 to pass through the seat 212. In some embodiments, the second driving member 223 may alter the seat 212 to allow the second driving member 223 to pass through the seat 212. For example, the seat 212 may tear, fragment, and/or a portion of the seat may be removed so that the diameter of the seat increases to allow the second driving member 223 to pass through the seat 212. Once the second driving member 223 passes through the seat 212, the second driving member 223 may pass through the wellbore tubular interior 218 to the bottom of the wellbore or to engage another seat on a downstream sleeve, as described in more detail herein.

When the sleeve 210 has shifted to the open configuration, a flowpath 402 may be established between the wellbore tubular exterior 216 and the wellbore tubular interior 218 through the valve 207. The flowpath 402 may direct any fluid to flow from the exterior of the wellbore tubular 216, through the filter element 202, through the valve 207, through the port 205, and into the wellbore tubular interior 218. The restricted flow path 301 may remain open and some amount of fluid may flow along the flowpath 301. However, the increased resistance to flow through the flow restriction 220 may limit the amount of fluid flowing along the flowpath 301 relative to the flowpath 402. An optional additional flowpath 402 may also be present that allows fluid to flow through a second filter element and into the valve 207. Flow along a reverse pathway may be prevented by the valve 206 and/or the valve 207. In the open configuration, the sleeve 210 may be axially translated out of radial alignment with the ports 204, 205. Fluid may then be produced from the wellbore tubular exterior 216 into the wellbore tubular interior 218 through the screen assembly in the open configuration.

Figure 6:
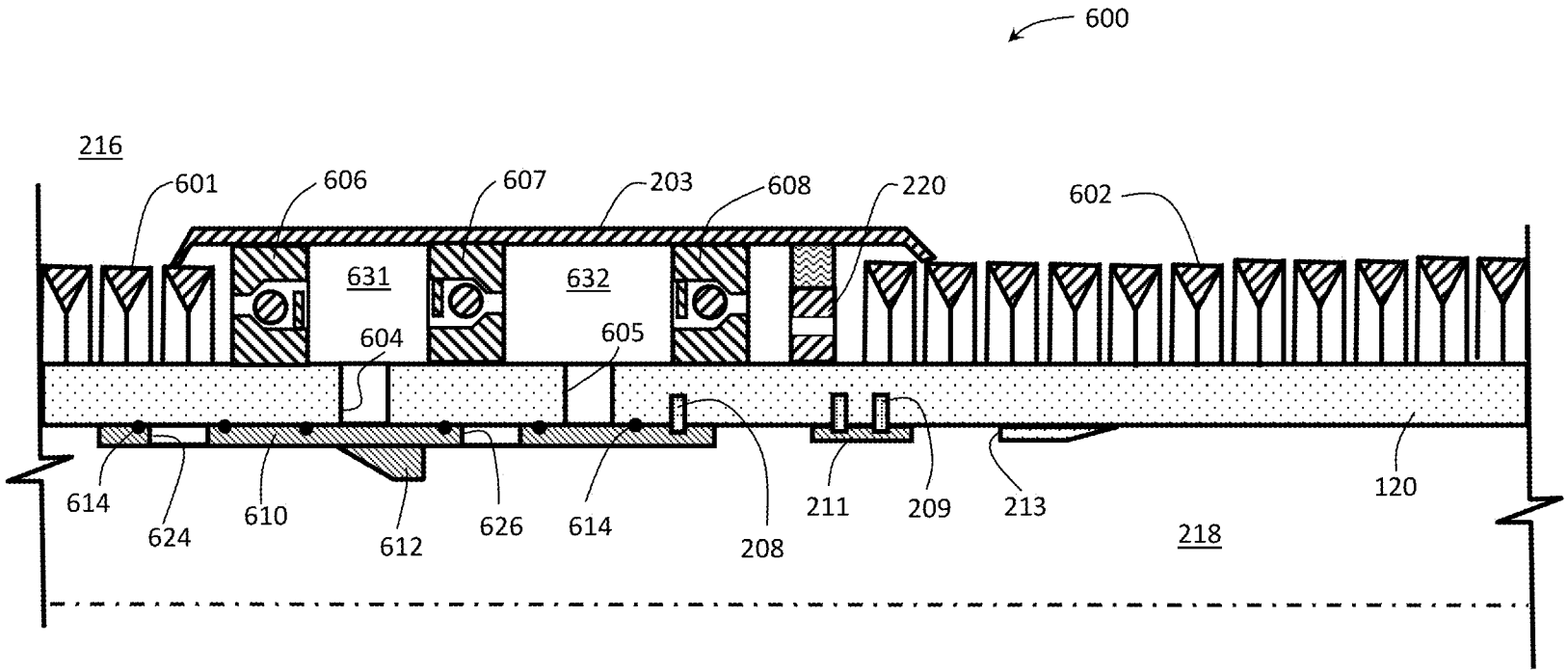
FIG. 6 is a partial cross-sectional view of an embodiment of a flow control apparatus.

Turning to FIG. 6, a partial cross-section of an embodiment of a flow control apparatus 600 is illustrated. The flow control apparatus 600 is similar to the flow control apparatus 200 discussed with respect to FIGS. 2-5, and the similar components will not be discussed in detail in the interest of clarity. In this embodiment, a sleeve 610 may selectively provide fluid flow through one or more fluid pathways using one or more apertures 624, 626 disposed through the sleeve 610. Similar to the flow control apparatus 200, the flow control apparatus 600 may be configured in several configurations including, but not limited to, a closed configuration, a restricted configuration, and/or an open configuration. In the closed configuration, the flow control apparatus 600 may substantially prevent flow between the wellbore tubular exterior 216 and the wellbore tubular interior 218. The flow control apparatus 600 may also be configured in a restricted configuration. In the restricted configuration, the flow control apparatus 600 may comprise a flow restriction, and the flow control apparatus 600 may provide a flow path between the wellbore tubular exterior 216 and the wellbore tubular interior 218 that restricts flow therethrough. In an embodiment, the flow control apparatus 600 may be configured in an open configuration in which the flow control device 600 may provide a relatively unrestricted flow path between the wellbore tubular exterior 216 and the wellbore tubular interior 218.

The flow control device 600 may comprise a plurality of valves 606, 607, 608 configured to control flow between the wellbore tubular interior 218 and an exterior 216 of the flow control device 200 and/or the filter element 601, 602 in at least one direction. The valves 606, 607, 608 may comprise any of the types of valves discussed herein with respect to FIG. 2. The plurality of valves 606, 607, 608 may allow fluid pressure to be maintained within the interior 218 of the wellbore tubular 120 while establishing one or more flow paths through the flow control device 600. In an embodiment, the valve 606 may prevent flow from the chamber 631 to the exterior 216 of the filter element 601 while allowing fluid flow from the exterior 216 of the filter element 601 into the chamber 631. The valve 607 may allow flow from the chamber 632 into the chamber 631, while preventing fluid flow from the chamber 631 to the chamber 632. The valve 608 may prevent flow from the chamber 632 to the exterior 216 of the filter element 602 while allowing fluid flow from the exterior 216 of the filter element 602 into the chamber 632. While illustrated as having a plurality of valves, one or more of the valves may not be present. When a pressure differential behind a driving member is desired, a sufficient fluid flow rate may be pumped into the wellbore to provide the pressure differential.

The sleeve 610 may be configured to axially translate along the wellbore tubular 120 interior surface. The sleeve 610 may be configured so that the sleeve 610 may at least partially obstruct one or more ports 604, 605 to thereby selectively allow or prevent fluid communication between the wellbore tubular exterior 216 and the wellbore tubular interior 218. One or more seals 614 may be disposed between the sleeve 610 and the wellbore tubular 120 to form a sealing engagement between the two components.

One or more apertures 624, 626 may be disposed through the sleeve 610. The apertures may provide fluid communication between the interior 218 of the wellbore tubular 120 and one or more of the chambers 631, 632 when one or more apertures 624, 626 are aligned with one or more of the ports 604, 605 in the wellbore tubular 120. The apertures 624, 626 may comprise a plurality of slits, holes, and/or openings, which may be similar to the cross-sections of one or more of the ports 604, 605. Using this configuration, the sleeve 610 may obstruct and/or permit fluid communication a plurality of times through a port 604, 605 as the sleeve 610 translates along the wellbore tubular 120. The number of apertures may be the same as or different than the number of ports.

As shown in the embodiment of FIG. 5, a first actuable member 208 engages the sleeve 610 and holds the sleeve 210 at a first axial position along the interior wall of the wellbore tubular 120. One or more second actuable members 208, 209 may engage a ring stop 211 and hold the ring stop 211 at a second predetermined longitudinal position along the interior of the wellbore 218. In an embodiment, the actuable members 208, 209 engaging the ring stop 211 may serve to define a location at which the sleeve 210 may be retained upon actuating the actuable member 208. For example, when one or more of the actuable members hold the sleeve 210 at a first axial position fails, the sleeve may axially translate into engagement with the rings stop 211. A no-go shoulder 213 may be disposed on the inner surface of the wellbore tubular 120 to serve as a further stop when the actuable members 208, 209 fail. Any number of ring stops and a no-go shoulder may be used to define the axial positions of the sleeve 210 along the wellbore tubular 120. The aggregate force required to actuate the actuable members 208, 209 may generally increase as the sleeve 210 axially translates along the wellbore tubular 120, so that an increasing force is required for each sequential actuation.

In use, the flow control apparatus 600 may operate similarly to the flow control apparatus 200, and the flow control apparatus 600 may be used to transition between various states or configurations including a closed configuration, a restricted configuration, and/or an open configuration. The embodiment illustrated in FIG. 5 shows the flow control apparatus 600 in a closed configuration. In this embodiment, the actuable member 208 is engaged with the sleeve 610, and the sleeve 610 is disposed at a position along the wellbore tubular 120 so that sleeve 610 is disposed over the ports 604, 605, thereby obstructing any flow paths between the wellbore tubular interior 218 and the wellbore tubular exterior 216. The seals 614 may operate in conjunction with the sleeve 610 to prevent fluid communication between the wellbore tubular exterior 216 and wellbore tubular interior 218 through the ports 604, 605.

Figure 7:
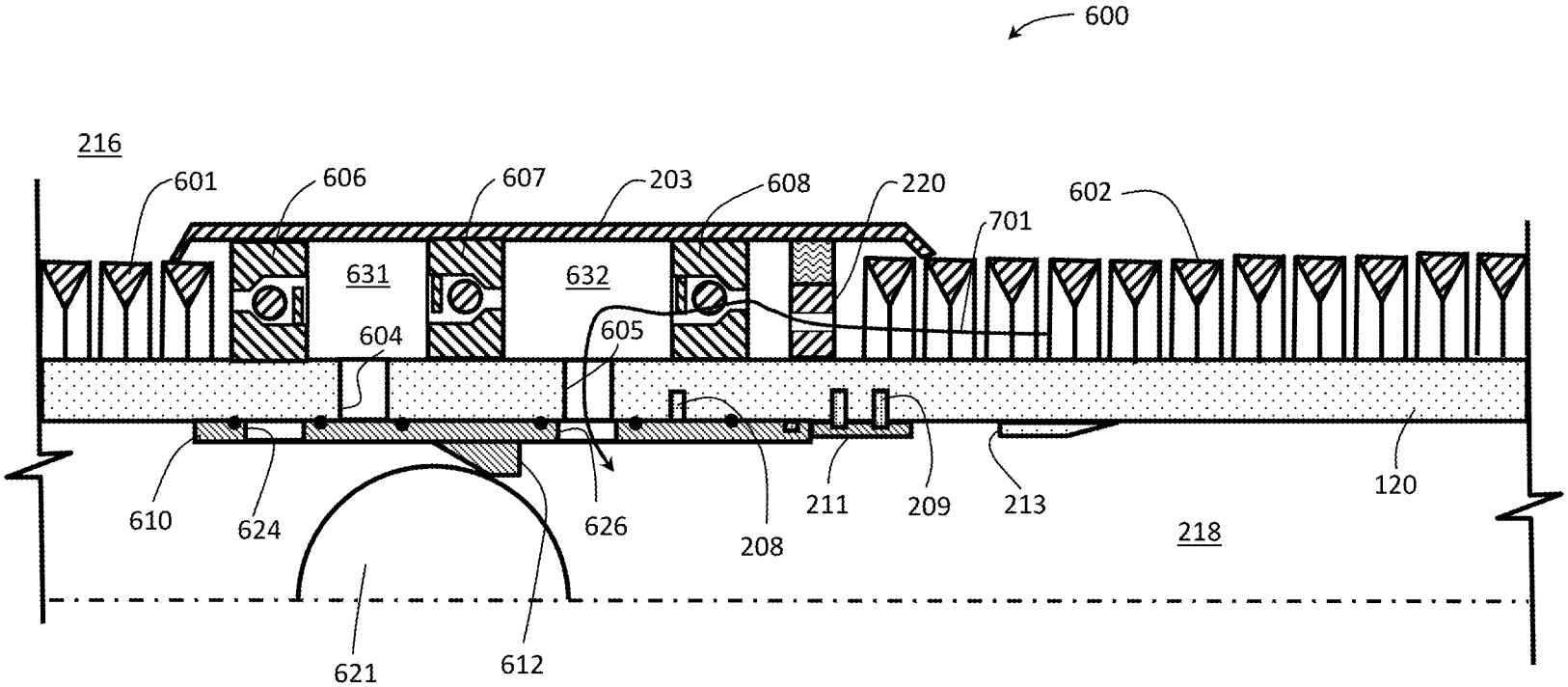
FIG. 7 is another partial cross-sectional view of an embodiment of a flow control apparatus in a second configuration.
Figure 8:
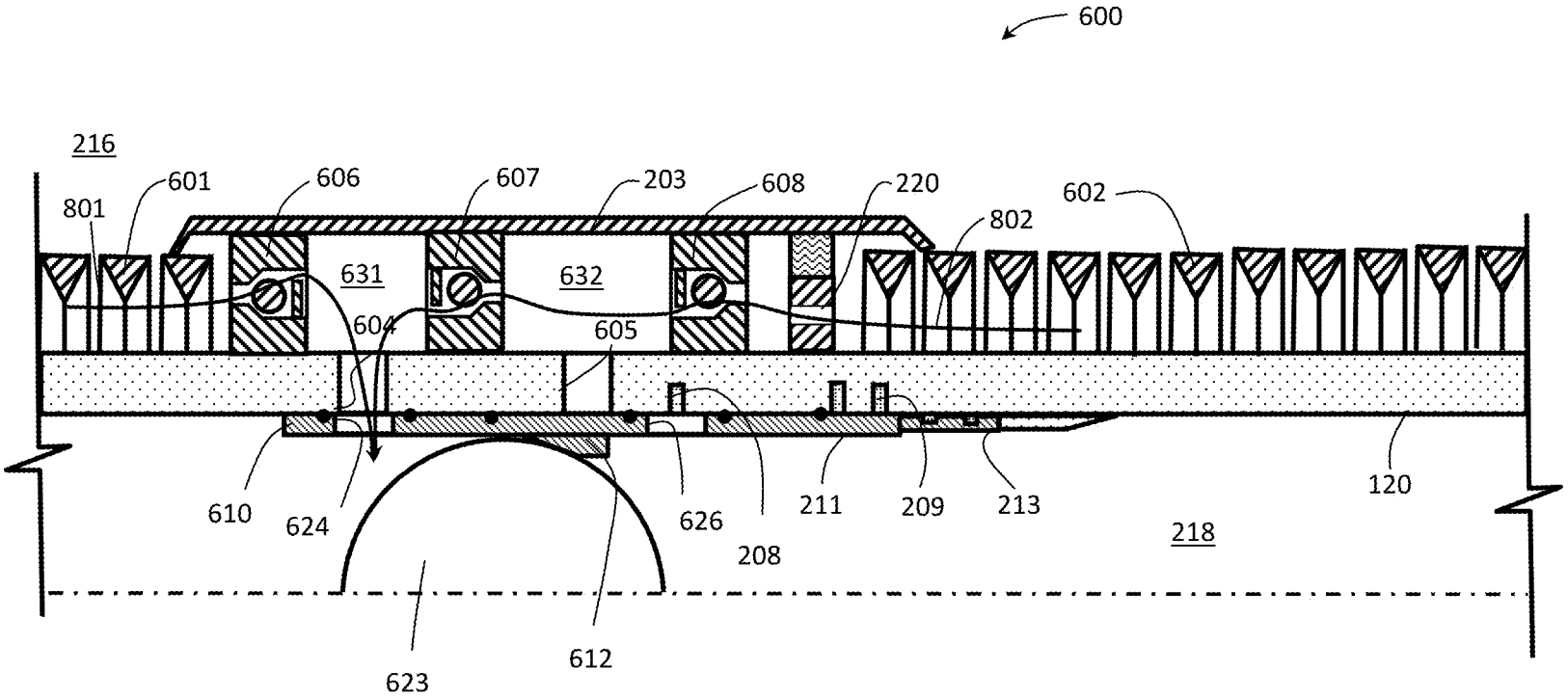
FIG. 8 is still another partial cross-sectional view of an embodiment of a flow control apparatus in a third configuration.

As illustrated in FIGS. 7 and 8, the flow control apparatus 600 may be transitioned from the closed configuration to the restricted configuration by engaging a driving member 621 with the seat 612. When the first driving member 621 is engaged with the seat 612, the driving member 621 may sealingly engage the seat 612 and thereby allow an increase in the pressure within the throughbore 218 and/or an increase in a pressure differential across the driving member 621 when fluid is pumped into the wellbore tubular interior 218. The resulting pressure differential may act on the area of the driving member 621 to create an axial force. When the axial force exceeds a threshold, the actuable member 208 engaging the sleeve 610 may actuate or fail to release the sleeve 610. The driving member 621 may remain engaged with the seat 612 as the sleeve 610 axially translates until the sleeve 610 engages the ring stop 211. The port 605 may be exposed as the aperture 626 in the sleeve 610 axially translates. The valves 607 and 608 may both actuate to prevent fluid flow from the chamber 632 to the chamber 631 or the wellbore tubular exterior 216 beyond the filter element 602. With the fluid maintained within the wellbore tubular interior 218, the sleeve 610 may continue to axially translate until engaging the ring stop 211. Upon engaging the ring stop 211, the sleeve 610 may be retained in the position illustrated in FIG. 6. The actuable member(s) 208, 209 may be configured to retain the sleeve 610 to allow the force on the first driving member 621 to be increased so that it may pass through the seat 612 without further axial movement of the sleeve 610.

Upon engaging the ring stop 211, the pressure behind the first driving member 621 may increase until the first driving member 621 deforms and/or alters the seat 612 to allow the first driving member 621 to be released from and pass through the seat 612. The pressure behind the first driving member 621 may be increased above a threshold pressure for deforming and/or altering the seat 612. In an embodiment, the first driving member 621 may elastically and/or inelastically deform the seat 612, permitting the first driving member 621 to pass through the seat 612. For example, the pressure acting on the first driving member 621 may rise above a threshold to allow the first driving member to radially expand the collet indicators forming the seat, thereby releasing the driving member 621 through the seat 612. In some embodiments, the first driving member 621 may alter the seat 612 to allow the first driving member 621 to pass through the seat 612. For example, the seat 612 may tear, fragment, and/or a portion of the seat may be removed so that the diameter of the seat increases (e.g., as illustrated in FIG. 7) to allow the first driving member to pass through the seat 612. Once the first driving member 621 passes through the seat 612, the first driving member 621 may pass through the wellbore tubular interior 218 to the bottom of the wellbore or to engage another seat on a downstream sleeve, as described in more detail herein.

When the sleeve has shifted to the restricted configuration, a flowpath 701 may be established between the wellbore tubular exterior 216 and the wellbore tubular interior 218. The flowpath 701 may direct any fluid to flow from the exterior of the wellbore tubular 216, through the filter element 602, through the flow restriction 220, into the valve 608, through the port 605, through the aperture 626, and into the wellbore tubular interior 218. Flow along a reverse pathway may be prevented by the valves 606 and 608. Flow from the exterior 216 of the filter element 601 may be prevented by the sleeve 610 being disposed over the port 604 and the valve 607. Thus, any fluid flow is directed through the flow restriction 220. Fluid may then be produced along the flowpath 701 into the interior 218 of the wellbore tubular 120.

As illustrated in FIGS. 7 and 8, the flow control assembly 600 may be transitioned from the restricted configuration to the open configuration by engaging a second driving member 623 with the seat 612 in the throughbore 218. When the second driving member 623 is engaged with the seat 612, the driving member 623 may sealingly engage the seat 612 and thereby prevent fluid communication through the wellbore tubular interior 218 past the driving member 623. In order to dispose the second driving member 623 in the wellbore and into engagement with the seat 612, fluid may be pumped into the wellbore tubular interior 218. A pressure may be developed behind the second driving member 623 by actuating the valves 606, 608 to a closed position, which may occur upon increasing the pressure within the wellbore tubular interior 218 above a threshold amount relative to the wellbore tubular exterior 216 and/or establishing a flow rate from the wellbore tubular interior 218 to the wellbore tubular exterior 216 above a threshold.

In an embodiment, the second driving member 623 may have a larger size and/or larger cross-sectional area than the first driving member 621. The larger size may allow the second driving member 623 to engage the seat 612 which may have been inelastically deformed and/or altered by the passage of the first driving member 621. For example as shown in FIG. 7, the seat may have had an inner portion removed or broken away by the passage of the first driving member 621. A larger second driving member 623 may then be used to engage the remaining portion of the seat 612. Whether or not the seat 612 was changed by the passage of the first driving member 621, the larger size may also allow for a larger axial force to be developed on the second driving member 623 and the sleeve 610. For example, when the seat comprises collet indicators, a larger size driving member 233 may be used to generate a larger translation force for the sleeve 610. The force developed by the second driving member 623 may be above the threshold for actuating the actuable members 208,209 retaining the stop ring 211 in position.

When the valves 606, 608 are closed and the second driving member 623 is engaged with the seat 612, fluid may be pumped into the wellbore tubular interior 218, which may increase the pressure within the throughbore 218 and/or increase a pressure differential across the second driving member 623. When the axial force exceeds a threshold, the actuable members 208, 209 engaging the ring stop 211 may actuate or fail to release the stop ring 211. Once the stop ring 211 is released, the stop ring 211 and the sleeve 610 may axially translate towards the no-go shoulder 213, and the second driving member 623 may remain engaged with the seat 612 as the stop ring 211 and the sleeve 610 axially translate towards the no-go shoulder 213. The port 604 may be exposed as the end of the sleeve 610 axially translates towards the no-go shoulder 213. The valves 606, 607 may then be actuated to prevent fluid flow from the wellbore interior 218 to the wellbore tubular exterior 216, thereby preventing fluid from flow outward and releasing the pressure buildup behind the second driving member 623. With the fluid maintained within the wellbore tubular interior 218, the stop ring 211 and the sleeve 610 may continue to axially translate until engaging the no-go shoulder 213. Upon engaging the no-go shoulder, the ring stop 211 and the sleeve 610 may be retained in the position illustrated in FIG. 8. The no-go shoulder 213 may be configured to retain the sleeve 610 to allow the force on the second driving member 623 to be increased so that it may pass through the seat 612 without further axial movement of the sleeve 610. Upon engaging the no-go shoulder 213, the pressure behind the second driving member 623 may increase until the second driving member 623 deforms and/or alters the seat 612 to allow the second driving member 623 to be released from and pass through the seat 612.

When the sleeve 610 has shifted to the open configuration, a flowpath 801 may be established between the wellbore tubular exterior 216 and the wellbore tubular interior 218 through the valve 606. The flowpath 801 may direct any fluid to flow from the exterior 216 of the wellbore tubular 120, through the filter element 601, through the valve 606, through the port 604, through the aperture 624, and into the wellbore tubular interior 218. A restricted flow path 802 may remain open through the filter element 602 and some amount of fluid may flow along the flowpath 802. However, the increased resistance to flow through the flow restriction 220 may limit the amount of fluid flowing along the flowpath 802 relative to the flowpath 801. Flow along a reverse pathway may be prevented by the valve 606 and/or the valve 607. In the open configuration, the sleeve 610 may be axially translated out of radial alignment with the port 604 while being disposed in alignment with the port 605. Fluid may then be produced from the wellbore tubular exterior 216 into the wellbore tubular interior 218 through the flow control apparatus 600 in the open configuration. The ability to open the filter element 601 to flow upon the transition of the sleeve 610 to the open position may provide a fresh filter element if the second filter element 602 were to become clogged.

While the apparatuses and methods described with respect to FIGS. 2-8 are described in terms of moving from a closed configuration to a restricted configuration, and further to an open configuration, the sleeve may be shifted using the actuable members, the sleeve, and the driving member to transition between any number of configurations. For example, the flow control device may be transitioned from an open position to a restricted position to a closed position. Alternatively, the flow control device may be transitioned from a restricted position to a closed position to an open position. In an embodiment, any combination of these configurations is possible. Further, more or less than three configurations may be possible. For example, the flow control device may be transitioned from a closed position to an open position using the sleeve and driving member described herein. In an embodiment, the flow control device could be transitioned between four or more configurations using the shifting sleeve and an appropriate number of actuable members, ring stops, and driving members.

Returning to FIG. 1, a wellbore tubular string 120 may comprise a plurality of well screen assemblies, which may comprise any of the flow control devices described herein. In an embodiment, the flow control devices in each well screen assembly may be the same or different. For example, the order of the configurations and/or the order of transition between the configurations can be the same or different. In an embodiment, a first flow control device may transition from a closed position to a restricted position to an open position while a second flow control device may transition from a restricted position to a closed position to an open position. Any combination of configurations or positions is possible.

In use, a single driving member may be used to actuate a plurality of flow control devices and transition the sleeves between positions. In an embodiment, a first driving member may be used to transition each flow control device to the next position. In this embodiment, the process of transitioning the sleeve using the driving member may be repeated for each sleeve along the string. When the driving member is released and passes through a first seat on a first sleeve, the driving member may pass to the next sleeve in the wellbore tubular string to transition the second sleeve.

In some embodiments, two or more of the flow control apparatuses may comprise different sized seats. In this embodiment, a first driving member may be used to transition one or more of the sleeves in the flow control devices, but not all of the sleeves. For example, one or more of the seats on the sleeves may have a diameter greater than the diameter of the driving member, and the first driving member may pass through the seat without transitioning the sleeve. A second or subsequent driving member having a larger diameter may then be used to actuate one or more additional sleeves disposed along the wellbore tubular string. This embodiment may allow for the selective activation and transitioning of a first set of flow control devices while leaving other flow control devices in their initial configurations.

In some embodiments, the flow control devices may be actuated out of a sequential order. As described above, a first driving member may be used to transition a sleeve from a first configuration to a second configuration. A second and larger driving member may then be used to transition the sleeve from the second configuration to a third configuration. In addition to this stepwise method, the second driving member may be used to transition the sleeve from the first position to the third position. Since the second driving member is configured to generate a certain axial force on the sleeve, the use of the second driving member when the sleeve is in the initial configuration may actuate the initial actuable member and one or more second actuable members. The sleeve may then be transitioned directly to a second or subsequent configuration.

Further, the flow control devices disposed along the wellbore tubular string may each have the same number of transitions and configurations or a different number of transitions and configurations. For example, a first sleeve may have three separate configurations while a second sleeve may have four or more separate configurations. In this embodiment, the first sleeve may be transitioned into a configuration in which the sleeve engages a no-go shoulder. Subsequent driving members may then pass through the first sleeve without further transitioning of the first sleeve. When the subsequent driving members pass through the first sleeve without transitioning the first sleeve, the subsequent driving member may pass to the second sleeve to transition the second sleeve to a subsequent configuration. The ability to provide different configurations and transitions may allow a wellbore tubular string to be reconfigured as desired during production, with some zones having more potential configurations than others.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed:

1. An actuating apparatus comprising:

a wellbore tubular having at least one flow path between an exterior of the wellbore tubular and an interior of the wellbore tubular;

a sleeve disposed within a wellbore tubular, wherein the sleeve is configured to longitudinally translate along the wellbore tubular interior between a first position preventing fluid flow through the at least one flow path and a second position allowing fluid flow through the at least one flow path;

at least one actuable member, wherein at least one actuable member engages the sleeve and the wellbore tubular; and a deformable seat engaged to the sleeve, wherein the deformable seat is configured to form a sealing engagement with a driving member, and wherein a first pressure is applied to the driving member on the deformable seat to release the at least one actuable member and translate the sleeve from the first position to the second position, and wherein the deformable seat is configured to deform in response to a second pressure applied by the driving member on the deformable seat to permit the driving member to pass through the deformable seat, the second pressure being higher than the first pressure.

2. The apparatus of claim 1, further comprising at least one flow path configure to provide fluid communication between an exterior of the wellbore tubular and an interior of the wellbore tubular, wherein the sleeve is configured to longitudinally translate along the wellbore tubular interior to at least one of close the at least one flow path or open the at least one flow path.

3. The apparatus of claim 2, further comprising a flow restriction disposed in the flow path.

4. The apparatus of claim 3, further comprising a filter element disposed in the flow path.

5. The apparatus of claim 1, further comprising at least one additional actuable member, wherein the at least one additional actuable member is disposed at a second longitudinal position along the interior wall of the wellbore tubular.

6. The apparatus of claim 5, wherein at least one additional actuable member engages a ring stop disposed at the second longitudinal position, and wherein the ring stop is configured to retain the sleeve at the second longitudinal position after actuation of the at least one actuable member.

7. The apparatus of claim 1, wherein the at least one actuable member comprises a shear screw, a shear pin, a shear ring, a collet indicator, or any combination thereof.

8. The apparatus of claim 1, wherein the sleeve is configured to at least partially obstruct at least one port disposed through the wellbore tubular.

9. The apparatus of claim 1, wherein the sleeve comprises one or more apertures disposed along the sleeve.

10. The apparatus of claim 1, wherein at least a portion of the deformable seat is configure to be removed in response to the driving member passing through the deformable seat.

11. The apparatus of claim 1, wherein the deformable seat is configure to elastically deform in response to the driving member passing through the deformable seat.

12. A method of reconfiguring a flow control apparatus, the method comprising:

blocking, by a sleeve, a flow path between an exterior of a wellbore tubular and an interior of the wellbore tubular, wherein the sleeve is disposed within the wellbore tubular, and wherein the sleeve is configured to axially translate along the interior of the wellbore tubular;

sealingly engaging a driving member with a seat disposed on the sleeve;

applying a first pressure to the driving member when the driving member is engaged with the seat;

axially translating the sleeve in response to the first pressure to provide the flow path between the exterior of the wellbore tubular and the interior of the wellbore tubular;

deforming the seat in response to a second pressure applied to the driving member on the deformable seat, the second pressure being higher than the first pressure; and passing the driving member through the seat.

13. The method of claim 12, wherein providing the flow path between the exterior of a wellbore tubular and the interior of the wellbore tubular occurs in response to the axially translating the sleeve.

14. The method of claim 12, wherein the blocking the flow path between the exterior of the wellbore tubular and the interior of the wellbore tubular occurs in response to the axially translating the sleeve.

15. The method of claim 12, wherein the wellbore tubular comprises a port, wherein the flow path passes through the port, and wherein providing a flow path comprises translating the sleeve out of radial alignment with the port.

16. The method of claim 12, wherein the wellbore tubular comprises a port, wherein the sleeve comprises an aperture, wherein the flow path passes through the port and the aperture, and wherein providing a flow path comprises translating the aperture in the sleeve into radial alignment with the port.

17. A method of reconfiguring a flow control apparatus, the method comprising:

disposing a first driving member within a flow control apparatus in a first configuration, wherein the flow control apparatus comprises:

a sleeve disposed within a wellbore tubular;

a seat disposed on the sleeve; and a first flow path between an exterior of the wellbore tubular and an interior of the wellbore tubular;

engaging the first driving member with the seat;

translating the sleeve along an interior surface of the wellbore tubular from a first position to a second position in response to engaging the first driving member with the seat;

reconfiguring the flow control apparatus to a second configuration in response to translating the sleeve from the first position to the second position, wherein the second configuration comprises at least one of a closed configuration, a restricted configuration, or an open configuration;

engaging a second driving member with the seat;

translating the sleeve along an interior surface of the wellbore tubular from the second position to a third position in response to engaging the second driving member with the seat; and reconfiguring the flow control apparatus to a third configuration in response to translating the sleeve from the second position to the third position, wherein the third configuration comprises at least one of a closed configuration, a restricted configuration, or an open configuration.

18. The method of claim 17, further comprising passing the first driving member through the seat, and deforming the seat in response to passing the first driving member through the seat.

19. The method of claim 17, wherein the second driving member has a larger diameter than the first driving member.

20. The method of claim 17, further comprising:

retaining the sleeve at the first position using one or more first actuable members, wherein the one or more first actuable members engage the sleeve and the wellbore tubular;

actuating the one or more first actuable members, wherein translating the sleeve from the first position to the second position occurs in response to actuating the one or more first actuable members;

retaining the sleeve at the second position using one or more second actuable members; and actuating the one or more second actuable members, wherein translating the sleeve from the second position to the third position occurs in response to actuating the one or more second actuable members.

* * * * *